US007367553B2

(12) United States Patent
Sato

(10) Patent No.: US 7,367,553 B2
(45) Date of Patent: May 6, 2008

(54) RECORDING APPARATUS

(75) Inventor: Naoto Sato, Okazaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 75 days.

(21) Appl. No.: 11/275,013

(22) Filed: Dec. 1, 2005

(65) Prior Publication Data

US 2006/0119698 A1 Jun. 8, 2006

(30) Foreign Application Priority Data

Dec. 2, 2004 (JP) ..... 2004-349519

(51) Int. Cl.
*B65H 5/00* (2006.01)

(52) U.S. Cl. ..... 271/10.11; 271/270; 347/104

(58) Field of Classification Search ..... 271/270, 271/10.02, 10.03, 10.11, 10.09, 3.15, 3.17, 271/4.02, 4.03, 4.08, 4.1; 347/104
See application file for complete search history.

(56) References Cited

U.S. PATENT DOCUMENTS

| | | | | |
|---|---|---|---|---|
| 5,742,318 | A * | 4/1998 | Miyauchi et al. | 347/134 |
| 6,048,115 | A | 4/2000 | Unishi et al. | |
| 6,428,162 | B2 * | 8/2002 | Kato | 347/104 |
| 6,505,833 | B2 * | 1/2003 | Kato et al. | 271/272 |
| 6,530,569 | B2 * | 3/2003 | Yamagishi | 271/270 |
| 6,606,466 | B2 | 8/2003 | Sato | |
| 7,222,849 | B2 * | 5/2007 | Ono | 271/272 |
| 2001/0054792 | A1 * | 12/2001 | Kato et al. | 271/272 |
| 2005/0056992 | A1 * | 3/2005 | Ono | 271/272 |

FOREIGN PATENT DOCUMENTS

| | | |
|---|---|---|
| JP | 9-193501 | 7/1997 |

* cited by examiner

*Primary Examiner*—Patrick Mackey
*Assistant Examiner*—Thomas Morrison
(74) *Attorney, Agent, or Firm*—Fitzpatrick Cella Harper & Scinto

(57) ABSTRACT

A recording apparatus includes a recording head for effecting recording on a recording material in accordance with recording information; first feeding means including a grip roller and a pinch roller disposed downstream of the recording head with respect to a recording material feeding direction; second feeding means including a grip roller and a pinch roller disposed upstream of the recording head with respect to the recording material feeding direction, wherein the recording device effects recording on a recording material fed by the first feeding means and the second feeding means, and wherein the first feeding means and the second feeding means have recording material feeding speeds which are different from each other; and a one-way clutch provided for the grip roller of one of the first and second feeding means which provides a lower recording material feeding speed, the one-way clutch being idly rotatable by a tension of the recording material.

1 Claim, 4 Drawing Sheets

RECORDING APPARATUS

FIELD OF THE INVENTION AND RELATED ART

The present invention relates to a recording apparatus equipped with a recording head which records on a recording medium, based on recording information.

Recording apparatuses equipped with a recording head which records on a recording medium based on recording information can be classified into various groups, based on the type of the recording method employed by the recording head of a recording apparatus. As for the recording methods employed by a recording apparatus, there are the ink jet recording method, laser beam recording method, thermal transfer recording method, thermal recording method, wire-dot recording method, etc. Among the recording apparatuses employing one of the above-mentioned recording methods, the recording apparatus employing the thermal transfer method (which hereinafter will be referred to simply as thermal transfer recording apparatus), which records with the use of a thermal head and an ink ribbon, has been used as a recording apparatus. Such an apparatus makes it relatively easy to record across the entirety of a sheet of recording medium, the size of which equals that of a postcard, an ordinary photograph, etc. As a mechanism for conveying a recording medium such as recording paper in a thermal transfer recording medium, there has been proposed a double-grip mechanism which is made up of a conveying means disposed on the upstream side of a thermal head, and a conveying means disposed on the downstream side of the thermal head, in terms of the recording medium conveyance direction (for example, Japanese Laid-open Patent Application 09-193501).

However, the mass-produced grip rollers employed to grip recording media are slightly different in diameter because of the tolerance allowed for mass-production. Thus, even in the case of a recording medium conveying mechanism designed so that the front and rear grip rollers are rotated at the same revolution, the front and rear grip rollers become different in conveyance speed when recording medium is conveyed while gripped by both the front and rear grip rollers (while remaining double-gripped). As a result, the recording medium is slackened or excessively tensed, which results in smearing, deviation in position as well as color, and/or the like image defect.

SUMMARY OF THE INVENTION

The present invention was made in view of the above-described technical problem, and its primary object is to provide a recording apparatus which does not cause a recording medium to slacken or excessively tense when conveying, by double gripping the recording medium on both the front and rear sides of the recording head, one for one. With such a design, the apparatus is capable of recording a high quality image, that is, an image which does not suffer from such image defects as smearing, positional deviation, color deviation, etc.

According to an aspect of the present invention, there is provided a recording apparatus comprising a recording head for effecting recording on a recording material in accordance with recording information; first feeding means including a grip roller and a pinch roller disposed downstream of the recording head with respect to a recording material feeding direction; second feeding means including a grip roller and a pinch roller disposed upstream of the recording head with respect to the recording material feeding direction, wherein the recording device effects recording on a recording material fed by the first feeding means and the second feeding means, and wherein the first feeding means and the second feeding means have recording material feeding speeds which are different from each other; and a one-way clutch provided for the grip roller of one of the first and second feeding means which provides a lower recording material feeding speed, the one-way clutch being idly rotatable by a tension of the recording material.

Another object of the present invention is to render a conveying means disposed on the front side of a recording head in terms of the recording medium conveying direction, different in recording medium conveying speed from a conveying means disposed on the rear side of the recording head, and to provide the grip roller of the conveying means which is slower in conveying speed, with a one-way clutch which allows the grip roller to slip forward as the tension of the recording medium becomes excessive, in order to prevent recording medium from being excessively tensed, or slackened, by the difference in conveying speed between the two conveying means.

According to the present invention, it is possible to eliminate the problem that when recording medium is conveyed by being double-gripped, the recording medium is slackened or excessively tensed, and therefore, it is possible to provide a recording apparatus capable of recording a high quality image, that is, an image which does not suffer from such image defects as smearing, positional deviation, color deviation, etc.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENT

Figure 1:
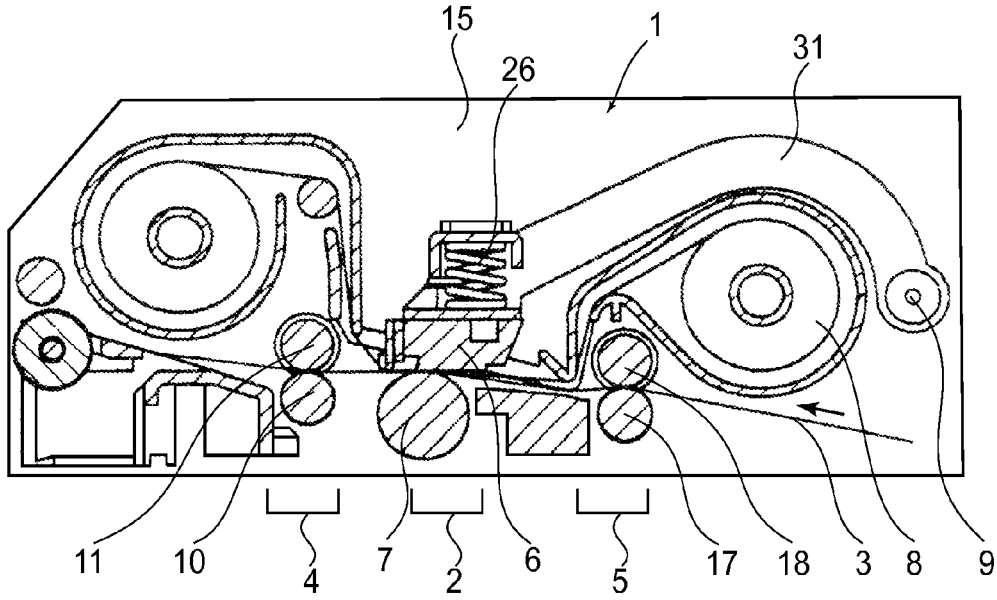
FIG. 1 is a schematic vertical sectional view of the recording apparatus in the first embodiment of the present invention.
Figure 2:
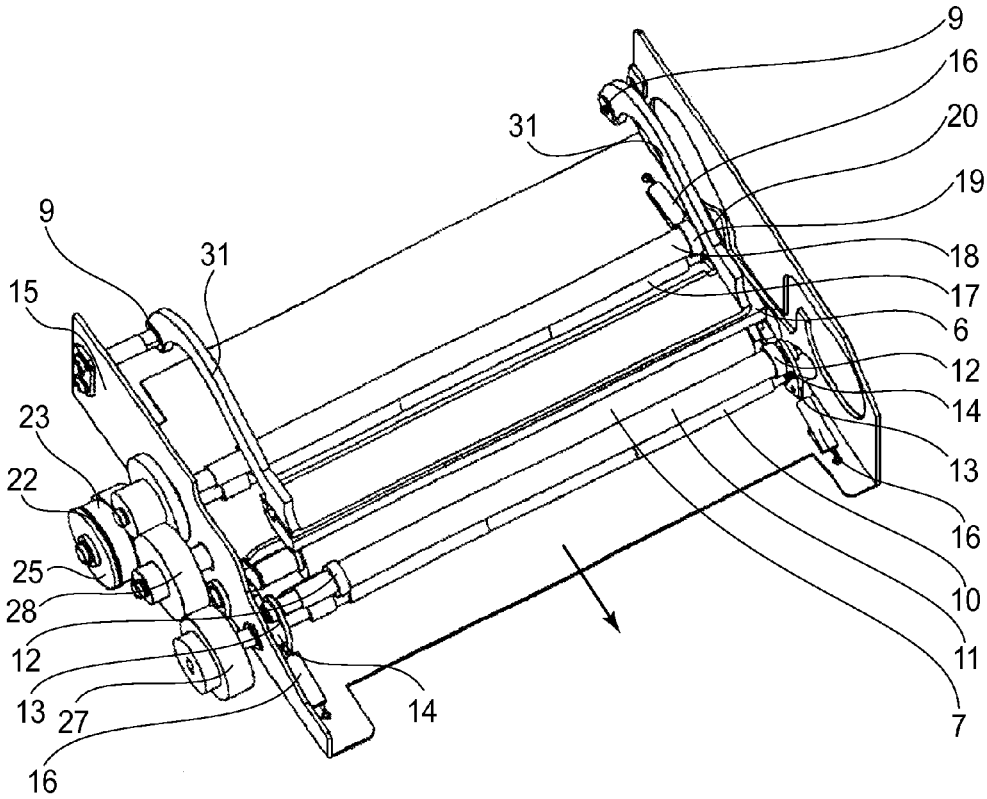
FIG. 2 is a schematic perspective view of the recording portion and recording medium conveying mechanism of the recording apparatus shown in FIG. 1.
Figure 3:
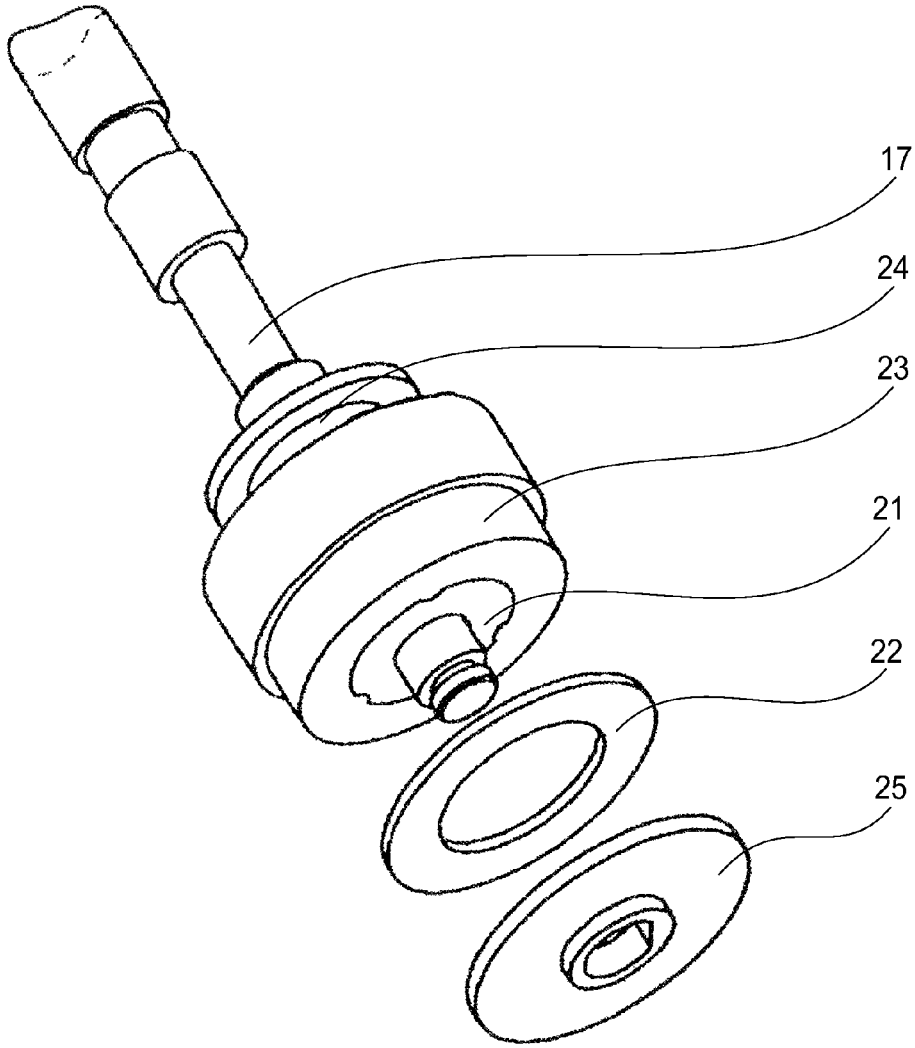
FIG. 3 is an exploded schematic perspective view of the one-way clutch of the second recording medium conveying means shown in FIG. 2.

Hereinafter, one of the preferred embodiments of the present invention will be concretely described with reference to the appended drawings. Throughout the appended drawings, if a given component, portion, or the like of the apparatus in a drawing is the same in referential symbol as the one in another drawing, the two are the same, or correspond to each other. FIG. 1 is a schematic vertical sectional view of the recording apparatus in one of the preferred embodiments of the present invention, and FIG. 2 is a schematic perspective view of the recording portion and recording medium conveying mechanism of the recording apparatus shown in FIG. 1. FIG. 3 is a schematic exploded perspective view of the one-way clutch of the second conveying means shown in FIG. 2. In this embodiment, the recording apparatus is of the thermal transfer type. Referring to FIGS. 1 and 2, a recording apparatus 1 is equipped with a recording portion 2 and a recording medium conveying mechanism. The recording portion 2 records (prints) an image on a sheet of recording medium 3 such as recording paper. The recording medium conveying mechanism is made up of first and second conveying means 4 and 5 which convey the recording medium 3.

The recording portion 2 is provided with a thermal head 6 as a recording head having multiple heat generation elements, an ink ribbon 8 which is to be conveyed in contact with the heated surface of the thermal head 6, and a rotational platen roller 7 which backs the ink ribbon 8 and recording medium 3 held pinched between the thermal head 6 and platen roller 7. The thermal head 6 is kept pressed against the platen roller 7. It is a recording head of the line type, which is provided with multiple heating elements aligned in the direction perpendicular to the direction in which the recording medium 3 is to be conveyed. The thermal head 6 is structured to be kept pressed by the spring 26 so that the portion of its surface, across which the multiple heating elements are aligned, is kept pressed against the platen roller 7. The thermal head 6 is a recording head which records on the recording medium 3 based on recording information. When it records an image, its multiple heating elements are selectively driven based on video signals (image signals) outputted from the control portion. As a result, an intended image is transferred from the ink ribbon 8 onto the recording medium 3.

The thermal head 6 is attached by its lengthwise ends, to the end portions of the left and right arms 31, one for one. The left and right arms 31 are attached to the left and right ends of the apparatus main assembly so that they can be pivoted about an arm supporting shaft 9. As the arms 31 are pivoted, the thermal head 6 is pressed upon, or moved away from, the platen roller 7. More specifically, during the actual recording of an image, the thermal head 6 is kept pressed against the platen roller 7, whereas when no image is recorded, the thermal head 6 is raised, being thereby moved away from the platen roller 7. While recording is made, the platen roller 7 is rotated by the friction between the platen roller 7 and the recording medium 3 which is being conveyed.

The first conveying means 4 is provided with a grip roller 10, a pinch roller 11, left and right rings 12, and left and right levers 13. The pinch roller 11 is on the top side of the grip roller 10. The pinch roller 11 is rotatably supported by a pair of shafts attached to the left and right levers 13, one for one. The left and right levers 13 are attached to the left and right lever shafts 14 by crimping or the like method, and the left and right lever shafts 14 are rotatably supported by the chassis 15. Each lever 13 is kept pressed by a tension spring 16 in the direction to rotate the lever 13 about the lever shaft 14 in a preset direction (lever 13 is kept under torque). Thus, the pinch roller 11 rotatably supported by the shafts attached to the left and right levers 13 is kept pressed against the grip roller 10 by the resiliency of the tension springs 16.

The surface (peripheral surface) of the grip roller 10 is provided with numerous fine projections for preventing the recording medium 3 from deviating in position (slipping) while being conveyed. In order to prevent these projections from collapsing, a small gap, which is less than the thickness of the recording medium 3 is provided between the grip roller 10 and pinch roller 11. This gap is provided by a pair of rings fitted around the left and right end portions of the pinch roller 11. When recording an image, the recording medium 3 is pressed upon the fine projections of the peripheral surface of the grip roller 10 by the pressure from the pinch roller 11, causing thereby the fine projections to grip into the recording medium, ensuring that as the grip roller 10 is rotated, the recording medium 3 is conveyed without slipping.

The second conveying means 5 is provided with a grip roller 17, a pinch roller 18, left and right rings 12, and left and right levers 20. The pinch roller 18 is on the top side of the grip roller 17. The pinch roller 18 is rotatably supported by a pair of shafts attached to the left and right levers 20, one for one. The left and right levers 20 are attached to the left and right lever shafts (unshown) by crimping or the like method, and the left and right lever shafts (unshown) are rotatably supported by the chassis 15. Each lever 20 is kept pressed by a tension spring 16 in the direction to rotate the lever 20 about the above-mentioned unshown lever shaft in a preset direction (lever 20 is kept under torque). Thus, the pinch roller 18 rotatably supported by the shafts attached to the left and right levers 20 is kept pressed against the grip roller 17 by the resiliency of the tension springs 16.

The surface (peripheral surface) of the grip roller 17 is provided with numerous fine projections for preventing the recording medium 3 from deviating in position (slipping) while being conveyed. In order to prevent these projections from collapsing, a small gap, which is less than the thickness of the recording medium 3, is provided between the grip roller 17 and pinch roller 18. This gap is provided by a pair of rings 19 fitted around the left and right end portions of the pinch roller 18. When recording an image, the recording medium 3 is pressed upon the fine projections of the peripheral surface of the grip roller 17 by the pressure from the pinch roller 18, causing thereby the fine projections to grip into the recording medium 3, ensuring that as the grip roller 17 is rotated, the recording medium 3 is conveyed without slipping.

Referring to FIG. 3, the grip roller 17 of the second conveying means 5 is fitted with a one-way clutch 21. The diameter of the conveying surface (peripheral surface) of the grip roller 17, which has the aforementioned numerous fine projections, is smaller than the diameter of the conveying surface of the grip roller 10 of the first conveying means 4. In other words, the first and second conveying means 4 and 5 are rendered different in recording medium conveyance speed. The grip roller 17 of the second conveying means 5, that is, the grip roller with a slower conveyance speed, is provided with the one-way clutch 21, which makes it possible for the grip roller 17 to slip in the direction to forward the recording medium 3 as the recording medium is excessively increased in tension.

If the grip roller 10 of the first conveying means 4 and the grip roller 17 of the second conveying means 5 are the same in rotational speed (angular velocity), two rollers 10 and 17 are different in recording conveying speed (peripheral velocity), because of the difference in diameter between their conveying surfaces. In other words, in the case of a recording medium conveying mechanism structured so that the recording medium 3 is conveyed by both the first and second conveying means 4 and 5, the conveying speed of the grip roller 10, which is on the downstream side, is greater than that of the grip roller 17, which is on the upstream side, rendering faster the speed at which the first conveying means 4 pulls the recording medium 3 than the speed at which the second conveying means 5 conveys the recording medium 3 toward the first conveying means 4, tensing thereby the recording medium 3. In this embodiment, however, the grip roller 17 of the second conveying means 5, or the upstream grip roller, is provided with the one-way clutch 21, through which driving force is transmitted to the grip roller 17. Therefore, as the above described situation in which the recording medium 3 is excessively tensed, occurs, the grip roller 17 is allowed by the one-way clutch to slip in the direction to forward the recording medium 3. As a result, the force generated, in the direction to tense the recording medium, by the difference in conveying speed between the two grip rollers 10 and 17 is eliminated, and therefore, the recording medium 3 is freed from the excessive tension.

Figure 4:
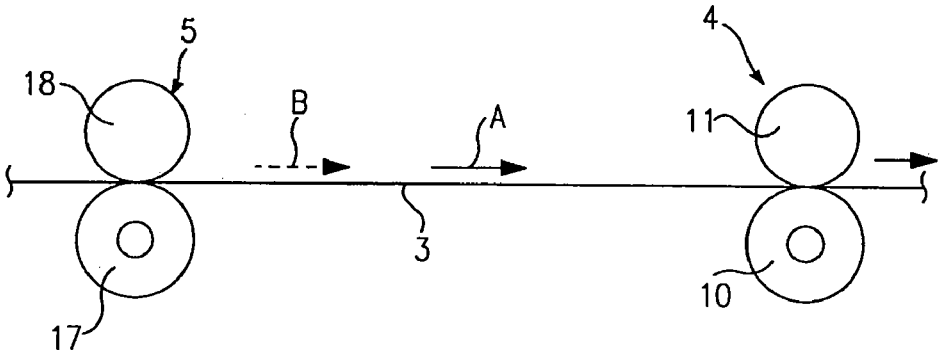
FIG. 4 is a schematic drawing showing the state of the recording medium conveying mechanism, in which a recording medium is being conveyed by the first and second conveying means on the downstream and upstream sides, respectively, in terms of the recording medium conveyance direction, in FIGS. 1 and 2.
Figure 5:
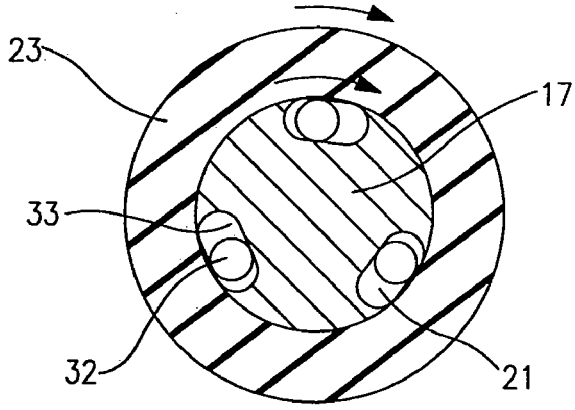
FIG. 5 is a schematic drawing of the one-way clutch disposed between the grip roller and grip roller gear of the second conveying means shown in FIGS. 1 and 2.

FIG. 4 is a schematic drawing showing the state of the recording medium conveying mechanism, in which the recording medium 3 is being conveyed by the first conveying means 4, or the downstream conveying means in terms of the recording medium conveyance direction, and the second conveying means 5, or the upstream conveying means, shown in FIGS. 1 and 2. FIG. 5 is a schematic drawing of the one-way clutch 21 disposed between the grip roller 17 and grip roller gear 23 of the second conveying means 5. Hereafter, the recording medium conveying mechanism in accordance with the present invention will be concretely described in detail regarding its structure, with reference to FIGS. 4 and 5.

In FIG. 4, an arrow mark A indicates the direction in which the recording medium 3 is conveyed. The first conveying means 4, that is, the downstream conveying means in terms of the recording medium conveyance direction, generates the recording medium conveying force with the use of the grip roller 10 and pinch roller 11, whereas the second conveying means 5, that is, the upstream conveying means in terms of the recording medium conveyance direction, generates the recording medium conveying force with the use of the grip roller 17 and pinch roller 18. Thus, if the grip roller 10, which is on the downstream side, and the grip roller 17, which is on the upstream side, are driven at the same rotational speed (angular velocity), tensional force indicated by an broken arrow B in FIG. 4 would be generated in the recording medium 2, because the downstream grip roller 10 is greater in diameter than the upstream grip roller 17. As for the rotational driving of the two grip rollers 10 and 17, they are driven through a gear train comprising the grip roller gears 27 and 23, with which the two grip rollers 10 and 17 are provided, one for one, and an idler gear 28 engaged with the two grip roller gears 27 and 23. As the power source for rotationally driving the grip rollers 10 and 17, an unshown recording medium conveyance motor is used.

Referring to FIG. 5, between the grip roller 17 and grip roller gear 23, the one-way clutch 21 is disposed. As for the structure of the one-way clutch 21 shown in FIG. 5, the peripheral surface of the grip roller 17 is provided with three cam grooves 33, which are evenly distributed in terms of the circumferential direction of the grip roller 17. In each of these cam grooves 33, a ball 32 is disposed so that the one-way clutch 21 engages to transmit the force for driving the grip roller 17 from the internal surface of the grip roller gear 23 to the grip roller 17, or disengage to prevent the force for driving the grip roller 17 from being transmitted from the internal surface of the grip roller gear 23 to the grip roller 17. In the case of the mechanism shown in FIG. 5, the one-way clutch 21 is designed so that as the grip roller gear 23 rotates in the clockwise direction indicated by a solid arrow mark in the drawing, the driving force is transmitted to the grip roller 17 from the internal surface of the grip roller gear 23, but, when the grip roller gear 23 rotates in the opposite direction, or the counterclockwise direction, the driving force is not transmitted to the grip roller 17, and the grip roller 17 is allowed to slip.

As described above, in this embodiment, the grip roller 17 of the second conveying means 5, that is, the upstream grip roller of the recording medium conveying mechanism, is provided with the one-way clutch 21 which makes up a part of the driving force transmitting portion of the second conveying means 5. Further, the conveying speed of the first conveying means 4, that is, the downstream conveying means, is rendered greater than that of the second conveying means 5, that is, the upstream conveying means. Therefore, as driving force is transmitted to the recording medium conveying mechanism, such tensional force that works in the direction to pull the recording medium 3 out of the nip of the second conveying mechanism is generated. However, as the tensional force is generated, the grip roller 17 is allowed to slip forward (in the direction of idle rotation), by the one-way clutch 21. As a result, the excessive tension of the recording medium 3 attributable to the difference in recording medium conveyance speed between the grip rollers 10 and 17 is canceled as soon as it is generated.

Moreover, the second conveying means 5, that is, the upstream conveying means, is provided with a toque limiting mechanism, such as the one shown in FIGS. 2 and 3, for preventing the grip roller 17 from freely rotating forward when the recording medium 3 is conveyed. As for the structure of this torque limiting mechanism, the mechanism is provided with: a clutch pressing plate 25 which rotates with the grip roller 17; a friction pad 22, which is bonded to one of the side walls of the clutch pressing plate 25, and which comes into contact with the corresponding side wall of the grip roller gear 23; and a compression spring 24, the resiliency of which acts in the direction to press the grip roller gear 23 upon the friction pad 22 bonded to the clutch pressing plate 25. With the provision of the above-described torque limiting mechanism for preventing the grip roller 17 from freely rotating when the amount of torque necessary to cause the grip roller 17 to slip forward is no more than a preset value, it is possible to prevent the grip roller 17 from slipping when it pulls the leading end portion of the recording medium 3 having been conveyed to the nip between the two rollers of the second conveying means 5 from an unshown recording medium feeding mechanism.

As described above, in this embodiment, the recording apparatus is provided with two conveying means 4 and 5, which are disposed at two locations, one for one, in terms of the recording medium conveyance direction, for conveying the recording medium by double gripping. Further, the grip roller 17 of the conveying means 5, that is, the conveying means on the upstream side, is provided with the one-way clutch 21. Therefore, it is possible to prevent the problem that when the recording medium 3 is conveyed by double gripping, it is excessively tensed, or buckled, by the difference in conveying speed between the two conveying means 4 and 5. Therefore, it is possible to prevent the formation of a print, the image of which suffers from smears, deviation in position and/or color, which is attributable to the changes in conveyance speed and/or stretching or shrinking of the recording medium. In other words, it is possible to continuously print at a high level of quality.

As described above, the present invention is applicable to various recording apparatuses regardless of the direction in which recording medium is scanned by a recording head. For example, not only is the present invention applicable to a recording apparatus of the serial type, which records by moving its recording head in a manner of scanning recording medium in the primary direction, that is, the direction perpendicular to the recording medium conveyance direction, but also, a recording apparatus of the line type, the recording head of which matches the entirety, or a part, of the width of recording medium, and which records by scanning recording medium with the use of its recording head only in the secondary direction, that is, the direction parallel to the recording medium conveyance direction. The application of the present invention to any of such recording methods produces the same effects as those described above. Further, in the above described embodiment of the present invention, the recording head was a thermal head. However, the present invention is also applicable to various recording apparatuses regardless of the recording method employed by a recording head. That is, the present invention is applicable to the ink jet recording method, thermal transfer recording method, thermal direct recording method, laser beam exposure recording method, wire-dot recording method, etc., and the application of the present invention to any of such recording methods yields the same effects as those described above.

Further, the present invention is also applicable to a recording apparatus employing only a single recording head, a recording apparatus such as a color recording apparatus employing multiple recording heads different in the color of the ink used for printing, a recording apparatus such as a gradation recording apparatus employing multiple recording heads which are the same in the color of the ink used for printing, but different in the color density of the ink used for printing, and also, a recording apparatus made up of various combinations of the preceding recording apparatuses, etc. The application of the present invention to any of such recording apparatuses produces the same effects as those described above.

Further, not only is a recording apparatus in accordance with the present invention usable as a stand-alone recording apparatus, but also, as the output device for such an apparatus as a copying machine, a facsimileing machine, a photographic image forming apparatus, and also, as the output device for such a apparatus as a computer. In other words, the present invention is applicable to a wide range of apparatuses which record an image based on image data, and the application of the present invention to any of such apparatuses yields the same effects as those described above.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 349519/2004 filed Dec. 2, 2004 which is hereby incorporated by reference.

What is claimed is:

1. A recording apparatus comprising:

a recording head for effecting recording on a recording material in accordance with recording information;

first feeding means including a grip roller and a pinch roller disposed downstream of said recording head with respect to a recording material feeding direction;

second feeding means including a grip roller and a pinch roller disposed upstream of said recording head with respect to the recording material feeding direction, wherein said recording head effects recording on a recording material fed by said first feeding means and said second feeding means, and wherein a feeding speed of said second feeling means is less than a feeding speed of said first feeding means;

a one-way clutch provided for the grip roller of said second feeding means, said one-way clutch being idly rotatable, in a direction of idle rotation, by a tension of the recording material; and a torque limit mechanism for applying a rotation resistance in the direction of idle rotation to said one-way clutch, wherein said torque limit mechanism comprises a friction grip member in contact with (i) a grip roller gear for transmitting a driving force to said grip roller of said second feeding means and (ii) a member integrally rotatable with said grip roller of said second feeding means.

* * * * *

UNITED STATES PATENT AND TRADEMARK OFFICE

CERTIFICATE OF CORRECTION

PATENT NO. : 7,367,553 B2
APPLICATION NO. : 11/275013
DATED : May 6, 2008
INVENTOR(S) : Sato It is certified that error appears in the above-identified patent and that said Letters Patent is hereby corrected as shown below:

ON THE TITLE PAGE:

At Item (57), Abstract, Line 13, "and ¶¶" should read --and--.

COLUMN 1:

Line 41, "when" should read --when a--.

COLUMN 2:

Line 20, "vent" should read --vent the--.
Line 24, "when" should read --when a--.

COLUMN 4:

Line 14, "rings 12," should read --rings 19--.

COLUMN 5:

Line 9, "above described" should read --above-described--.
Line 43, "an" should read --a--.
Line 44, "medium 2," should read --medium 3,--.

COLUMN 6:

Line 28, "toque" should read --torque--.

COLUMN 7:

Line 1, "which" should read --which a--.
Line 4, "scanning" should read --scanning a--.
Line 9, "of" should read --of a--.
Line 10, "scanning" should read --scanning the--.
Line 15, "above described" should read --above-described--.
Line 42, "facsimileing" should read --facsimile--.

UNITED STATES PATENT AND TRADEMARK OFFICE

CERTIFICATE OF CORRECTION

PATENT NO. : 7,367,553 B2
APPLICATION NO. : 11/275013
DATED : May 6, 2008
INVENTOR(S) : Sato It is certified that error appears in the above-identified patent and that said Letters Patent is hereby corrected as shown below:

COLUMN 8:

Line 28, “feeling” should read --feeding--.

Signed and Sealed this

Fourteenth Day of April, 2009

JOHN DOLL
*Acting Director of the United States Patent and Trademark Office*